US006659019B2

(12) United States Patent
Gruber et al.

(10) Patent No.: US 6,659,019 B2
(45) Date of Patent: Dec. 9, 2003

(54) FOLDING PALLET-STACKING DEVICE

(75) Inventors: Robert V. Gruber, Hermosa Beach, CA (US); Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/918,079

(22) Filed: Jul. 30, 2001

(65) Prior Publication Data

US 2003/0019403 A1 Jan. 30, 2003

(51) Int. Cl.[7] ..... B65D 19/38

(52) U.S. Cl. ..... 108/53.5; 108/54.1; 108/57.26; 108/901; 206/386

(58) Field of Search ..... 108/53.1, 53.5, 108/54.1, 57.16, 57.25, 57.28, 901, 91, 92; 211/175, 195; 206/386, 427, 429

(56) References Cited

U.S. PATENT DOCUMENTS

| | | | | | |
|---|---|---|---|---|---|
| 2,936,985 | A | * | 5/1960 | Doerr et al. | 108/54.1 |
| D241,777 | S | | 10/1976 | Allman et al. | |
| 4,095,769 | A | * | 6/1978 | Fengels | 108/54.1 |
| 4,360,231 | A | | 11/1982 | Bolin | |
| 4,567,981 | A | | 2/1986 | Headon | |
| 4,653,651 | A | * | 3/1987 | Flum | 108/53.1 |
| 4,735,321 | A | | 4/1988 | Day | |
| 5,016,761 | A | | 5/1991 | Stoddard et al. | |
| 5,105,746 | A | * | 4/1992 | Reynolds | 108/54.1 |
| 5,213,211 | A | | 5/1993 | Umiker | |
| 5,330,050 | A | | 7/1994 | Stansbury et al. | |
| 5,586,666 | A | * | 12/1996 | Squitieri | 108/54.1 |
| 5,829,361 | A | * | 11/1998 | Fenton | 108/51.11 |
| 5,894,804 | A | | 4/1999 | Werner | |
| 5,950,546 | A | | 9/1999 | Brown et al. | |
| 6,119,861 | A | * | 9/2000 | Schneider | 108/53.1 |

FOREIGN PATENT DOCUMENTS

| | | | | |
|---|---|---|---|---|
| EP | 436783 | * | 7/1991 | 108/53.5 |
| GB | 2260076 | * | 4/1993 | 108/91 |
| WO | WO 00/24636 | | 5/2000 | |

* cited by examiner

*Primary Examiner*—Lanna Mai
*Assistant Examiner*—Hanh V. Tran
(74) *Attorney, Agent, or Firm*—Konstantine J. Diamond

(57) ABSTRACT

A foldable device for facilitating the stacking of adjacent pairs of pallets loaded with container arrays includes a pair of pivotally-interconnected sections. Each section includes a generally flat bottom surface adapted to rest on a respective top layer of exposed container tops, and a top surface that include surface features whose uppermost portions cooperate to define a first reference plane. Each section includes a plurality of complementary hinge components defining a pivot axis that lies in a second reference plane located between the section's bottom surface and first reference plane, and further includes detents by which to maintain the bottom surfaces of each section pair in a substantially coplanar relationship when the hinged sections are spread open. Preferably, the surface features of each section pair are complementary such that, the assembly is folded about the resulting shared pivot axis, the bottom surfaces become generally parallel-spaced to facilitate device storage.

26 Claims, 6 Drawing Sheets

FOLDING PALLET-STACKING DEVICE

CROSS-REFERENCE TO RELATED APPLICATIONS

The invention is related to U.S. application Ser. No. 09/420,431, filed Oct. 12, 1999, now U.S. Pat. No. 6,530,476, entitled "Pallet Stacking Device," which is assigned to the assignee of the invention.

BACKGROUND OF THE INVENTION

1. Technical Field

The invention relates to a pallet-stacking device which maximizes the vertical stacking capability of adjacent pairs of loaded pallets.

2. Background Information

Bottle-carrying crates or "carriers" are typically stacked in vertical sets on top of pallets to create three-dimensional "container arrays." For example, bottle carriers filled with blow-molded plastic bottles are often stacked in perhaps three to seven layers atop a given pallet. Such bottle carriers typically define bottle seats in an upper surface within which to receive the base portion of each bottle, and recesses in a lower surface within which to receive the tops of the bottles carried in the next-lower bottle carrier. Alternatively, cardboard or molded-plastic tier sheets are often used to separate each bottle carrier layer. Such a pallet loaded with stacked bottle carriers is conveniently handled by a forklift for shipment or storage.

Because vertical space in a warehouse is significantly less expensive than floor space, it is desirable to stack fully-loaded pallets vertically as high as possible. However, various problems arise in stacking loaded pallets directly on top of other fully loaded pallets, including those associated with the possible uneven loading of the top layer of exposed container tops by the three horizontally-spaced slats that typically define the bottom surface of a wooden pallet; and the resulting stack of pallets frequently lacks the desired stability.

Under one prior art approach to increase the stacking capacity of fully-loaded pallets, as taught in U.S. Pat. No. 5,016,761 to Stoddard et al., a "top cap member" is secured on top of the loaded pallet to provide a stable supporting surface for another pallet. The top cap member is formed from a monolithic plastic sheet of uniform thickness that is deformed to provide raised lands on its upper surface and corresponding dimples on its lower surface (the dimples being positioned to receive the tops of containers forming the uppermost layer of the loaded pallet). The presence of the underside dimples makes sliding the top cap member laterally across the uppermost layer of container tops more difficult when preparing the loaded pallet for stacked storage or display.

According to another prior art approach, as taught in U.S. Pat. No. 5,894,804, a two-ply, pliable separator sheet is used to separate the layered pallets. The upper surface includes raised nubs while the lower surface includes corresponding concavities. Because the sheet is pliable, the nubs that engage the underside of the upper pallet collapse under its weight to thereby ensure that the pallet's load is not borne exclusively by the nubs. The separator sheet's other, non-collapsed nubs form a "raised barrier" resisting sliding movement of the upper pallet relative to the lower pallet. The lower ply material is also said to have a relatively greater coefficient of friction than that of the upper ply material, to thereby allow the lower surface to "grip" the cargo loaded on the lower pallet. Unfortunately, the pliable aspect of such separator sheets makes handling and storage of such sheets more difficult, while the "grippy" lower ply makes it more difficult to slide the sheet across the top of the lower pallet prior to stacking the upper pallet on top of the sheet. Still further, the use of two materials necessarily increases the cost and complexity associated with production of such separator sheets. And, lastly, the pliable nature of such separator sheets limits the stability of the resulting pallet stack because the sheet can only serve to prevent splaying of the lower pallet's cargo and does not otherwise serve to improve the quality of the surface upon which the upper pallet rests.

SUMMARY OF INVENTION

It is an object of the invention to provide a durable pallet-stacking device that is useful in optimizing the height to which loaded pallets can be vertically stacked.

It is also an object of the invention to provide a durable pallet-stacking device that improves the quality of the surface upon which an upper pallet of a stack of pallets rests.

Yet another object of the invention is to provide a pallet-stacking device that can be used to improve the stability of adjacent stacks of loaded pallets and, yet, can assume a more compact form for storage between uses.

Under the invention, an article or device for use in stacking adjacent pairs of pallets loaded, for example, with stacked container arrays includes a pair of interconnected sections. Each section of the device has a generally flat bottom surface adapted to rest on top of a respective loaded pallet, for example, the container tops of an uppermost layer of the container array. Each section of the device also has a top surface that includes a plurality of raised surface features on which to support another pallet, and a first edge including a plurality of hinge components from the group consisting of a first hinge component and a second hinge component. By way of example only, in an exemplary embodiment, the first and second hinge components respectively include a pivot pin and a pin grip that, preferably, are formed such that the two sections can be snapped together when one section is disposed at a predetermined angle, such as a 90° angle, relative to the other section. In accordance with a feature of the invention, an uppermost portion of each raised surface feature of each section lies within a respective first reference plane, with the first reference plane being in a substantially parallel-spaced relation to the bottom surface; and the hinge components of the sections cooperate to interconnect the sections for relative pivoting movement about a pivot axis that lies beneath the respective first reference plane of each section.

Most preferably, the surface features of the top surface include a plurality of raised portions or lands separated by a plurality of lowered portions or valleys. In an exemplary embodiment, the raised portions extend in a direction generally perpendicular to the pivot axis, with the resulting parallel-spaced raised lands extending substantially across a longitudinal dimension of the section. In accordance with another feature of the invention, the surface features of the first section are preferably complementary to the surface features of the second section, and the pivot axis preferably lies between the first reference plane defined by the raised lands and a second reference plane that intersects the lowermost portions of the valleys on the top surface of each section. In this manner, the raised portions of the first section oppose the lowered portions of the second section when the first section is pivoted on top of the second section, thereby providing the folded device with a compact form that is well suited for stacked storage. Most preferably, the first and second sections have a substantially identical shape to facilitate manufacture and lower the cost of the device using, for example, two identical, injection-molded plastic sections.

In accordance with yet another feature of the invention, the hinged edge of each section also includes one or more respective edge features that together cooperate to restrict relative pivoting movement of the first and second sections about the pivot axis, thereby improving device rigidity when opened. While the invention contemplates any suitable combinations of edge features for restricting such relative pivoting movement, an exemplary embodiment includes lateral features defined on the pin grips of one section that resiliently engage side surfaces defining the cut-out region of the other section adjacent to the pivot pin. The exemplary embodiment also includes cooperating edge features that define a detent, for example, a tongue and slot arrangement, for locking the first section relative to the second section about the pivot axis when the bottom surface of the first section is substantially coplanar with the bottom surface of the second section. The exemplary embodiment further includes cooperating edge features that abuttingly engage as the bottom surface of the first section is urged into a substantially coplanar relationship with the bottom surface of the second section.

In accordance with still another feature of the invention, each section of the device further includes a small lip extending along a second edge that is opposite the hinge, and that projects downwardly beneath the bottom surface of the section. The lip advantageously prevents longitudinal sliding movement of the device after the device is positioned atop and across a pair of adjacent loaded pallets, while the otherwise generally flat bottom surface of the device facilitates the lateral insertion, removal and alignment of the device atop and across the loaded pallets. The device further includes a plurality of handles that are integrally defined in each section, preferably along each longitudinal edge of the device. The handles further facilitate the lateral insertion and removal of the device and, when defined in each section such that the handles of the first section are generally aligned with the handles of the second section when the first section is pivoted on top of the second section, the handles conveniently facilitate handling of the folded device.

DETAILED DESCRIPTION OF THE PREFERRED EMBODIMENT

Figure 1:
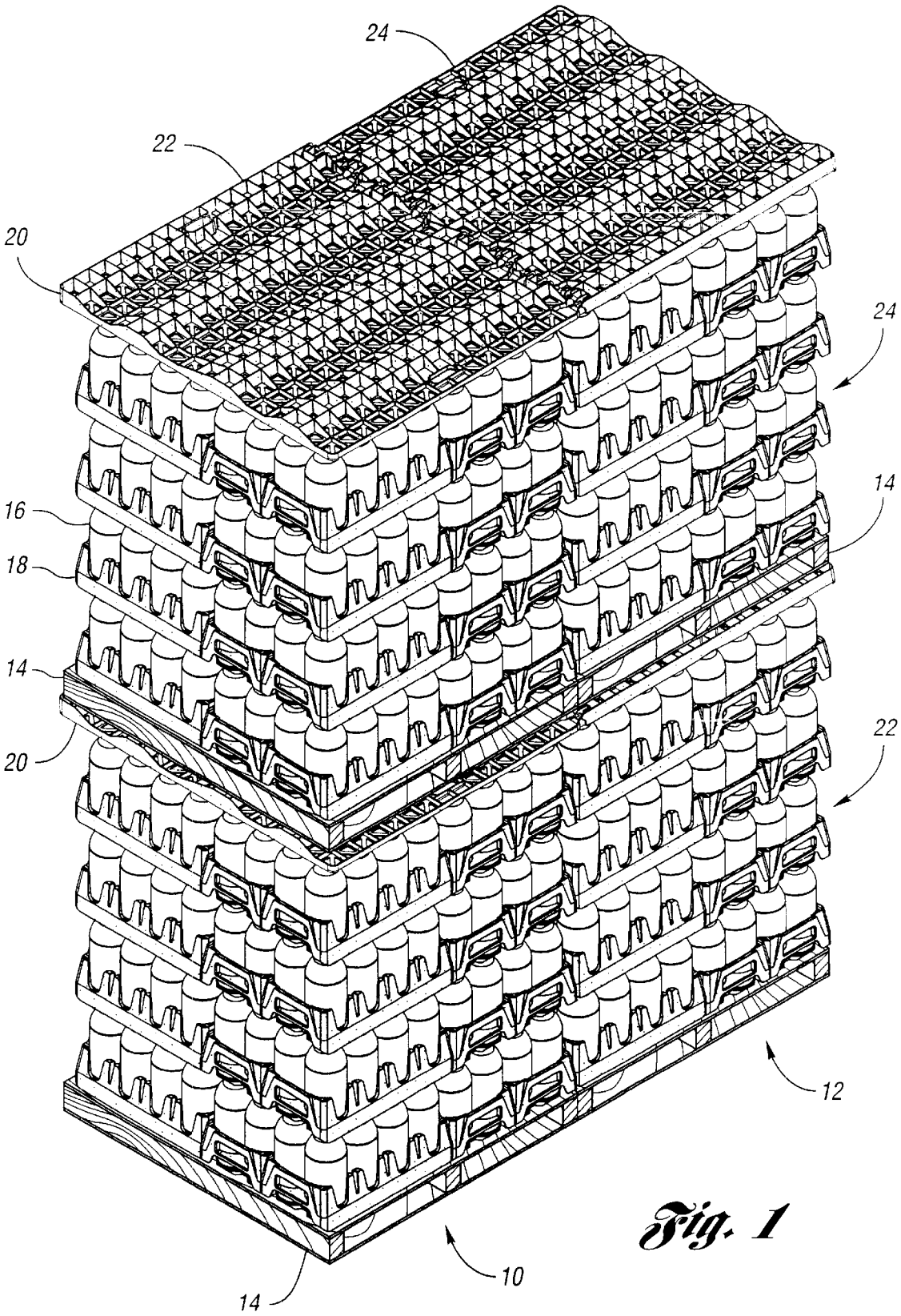
FIG. 1 is a perspective view of a pair of adjacent stacked pallets employing a folding pallet-stacking device in accordance with the invention.

FIG. 1 is an illustration of a pair of adjacent stacks 10,12 of pallets 14 that are each loaded with multi-layer container arrays 16 using conventional bottle carriers 18. In accordance with the invention, a first foldable pallet-stacking device 20 is positioned between the first and second vertical tiers 22,24 of pallets 14 to thereby impart substantially greater stability to resulting pallet stacks 10,12, while a second and identical foldable pallet-stacking device 20 is placed atop the second tier 24 of pallets 14 in anticipation of receiving yet another stacked tier of loaded pallets (not shown). As seen in FIG. 1, under the invention, the device 20 advantageously promotes load stability by laterally tying together the adjacent stacks 10,12 of pallets 14.

Figure 2:
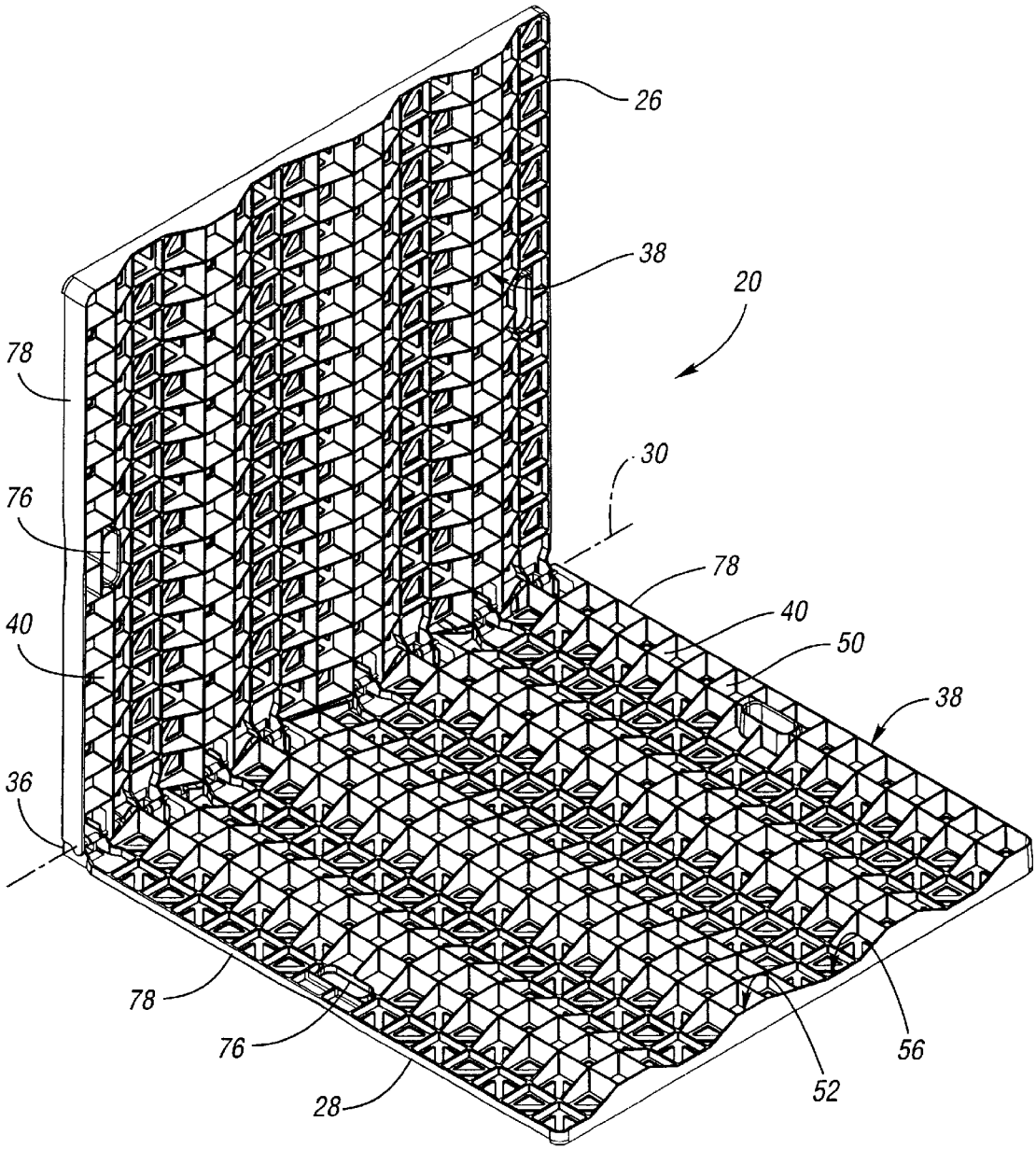
FIG. 2 is a perspective view of the device of FIG. 1, showing with the device's first section pivoted roughly halfway toward the open position relative to the second section.
Figure 3:
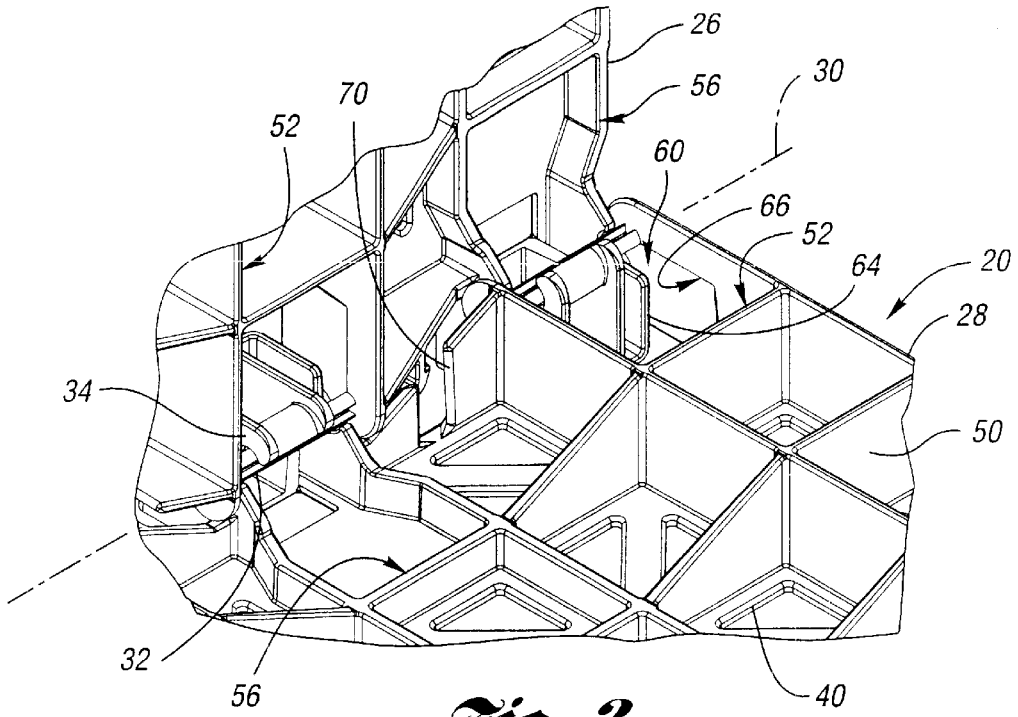
FIG. 3 is an enlarged view of a hinge formed by the respective hinge components of the first and second sections of the device when positioned as illustrated in FIG. 2.
Figure 8:
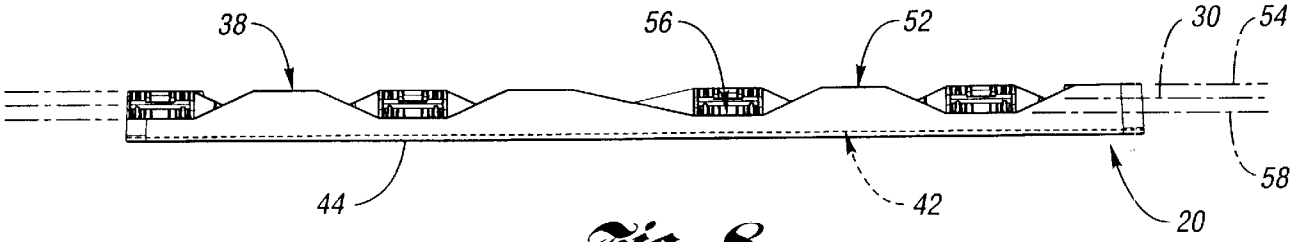
FIG. 8 is an end view of the opened device, better illustrating the parallel-spaced lands and valleys defined in the top surface of each section.
Figure 9:
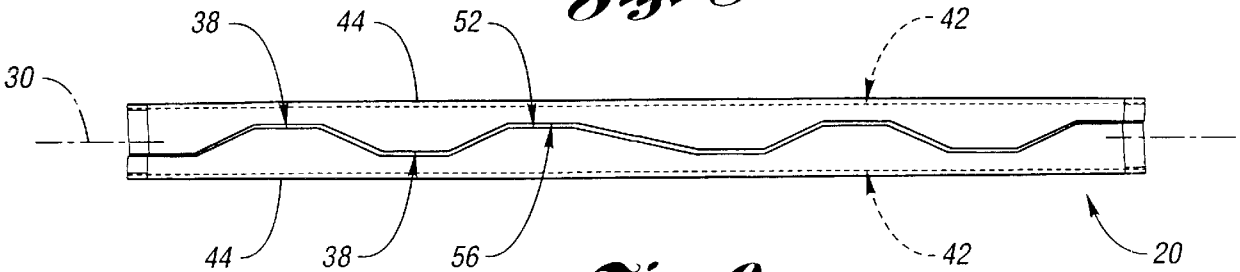
FIG. 9 is an end view of the device from the same vantage point as that of FIG. 8, but with the first section of the device now pivoted on top of the second section.

Referring to FIGS. 2–9, the device 20 includes two sections 26,28 that are pivotally interconnected along a pivot axis 30 by a plurality of hinge components 32,34 that are defined in a respective first edge 36 of each section 26,28. As seen in FIG. 2, the pivotal interconnection of the device's first and second sections 26,28 allows the device 20 to be conveniently folded about the pivot axis 30. As discussed below, the top surfaces 38 of each section 26,28 cooperate with the relatively-high position of the pivot axis 30 to thereby provide the resulting folded device 20 with a generally rectangular cross-section that is itself well suited for stacked storage, as illustrated in FIG. 9.

Figure 6:
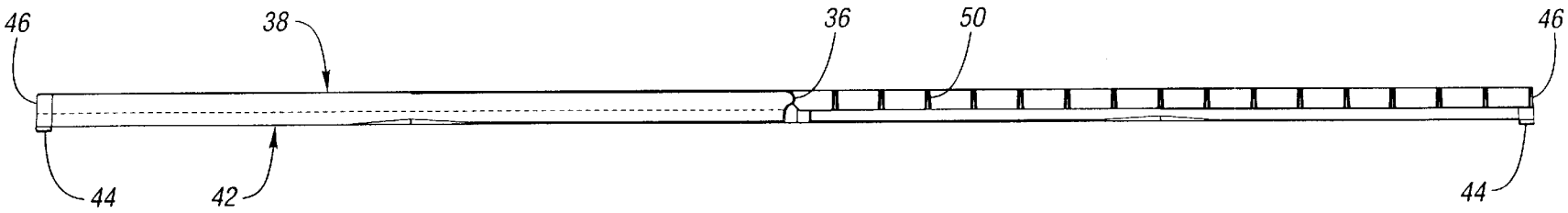
FIG. 6 is a side elevational view of the device when the device is fully opened.
Figure 7:
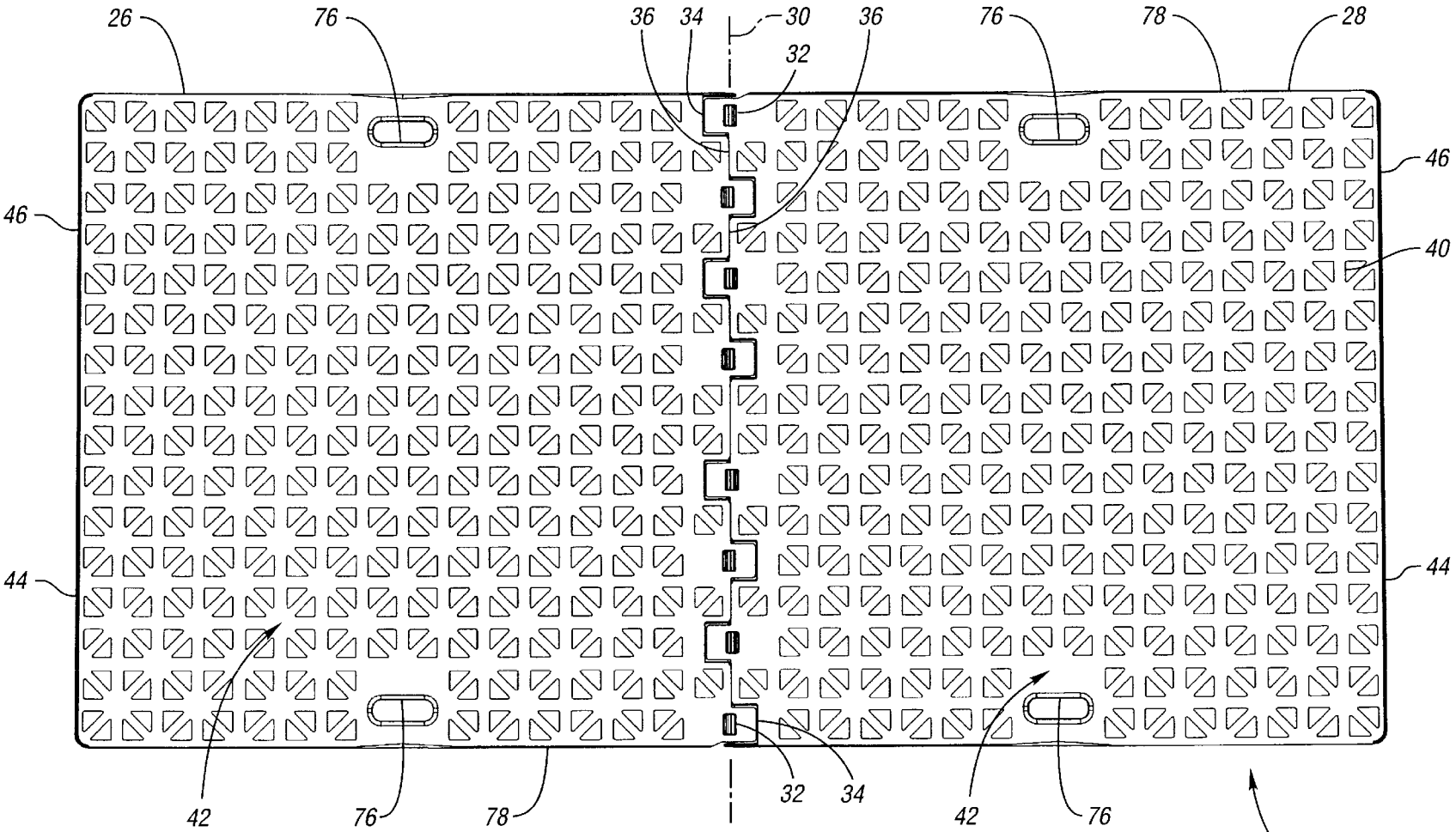
FIG. 7 is a bottom plan view of the device when the device is fully opened.

Returning to FIGS. 1–7, each section of the exemplary device 20 includes a grid structure 40 that is conveniently formed of any suitable injection-molded plastic such as a polypropylene. As best seen in FIGS. 6, 8 and 9, the lower portions of the grid structure 40 define a generally flat bottom surface 42 on each section 26,28. The generally flat bottom surface 42 is thus adapted for easy sliding placement atop a given tier of adjacent pallets 14, and is preferably free of any raised or lowered portions which otherwise might make it more difficult or tedious to align the device 20 atop the two adjacent pallets 14. However, a small, downwardly-projecting retaining lip 44 is preferably defined on the bottom of each section 26,28 along a second edge 46 opposite the first edge 36, thereby defining a pair of such retaining lips 44 on opposite longitudinal ends of the opened device 20, as best illustrated in FIGS. 6 and 7. The retaining lips 44 advantageously prevent longitudinal sliding movement of the device 20 once the device 20 is positioned atop and across a tier 22,24 of loaded pallets 14 while otherwise permitting lateral insertion and removal of the device 20. The retaining lips 44 further advantageously facilitate alignment of the device 20 atop and across the loaded pallets 14.

As best seen in FIGS. 2–4 and 8, the grid structure's vertical ribs 50 are of varying heights and thus the tops of the vertical ribs 50 cooperate together to define the top surface 38 on each section 26,28 that is characterized by a plurality of parallel-spaced raised portions or lands 52 that together define a first reference plane 54 that is in parallel-spaced relation with the section's generally flat bottom surface 42, with the lands 52 being separated by a plurality of lowered portions or valleys 56. It will be appreciated that the grid structure's pattern of vertical ribs 50 and cross-ribs of each section 26,28 further serve to provide the device 20 with enhanced structural rigidity and integrity while otherwise serving to reduce the overall weight of the device 20. The open nature of the grid structure 36 further advantageously permits device cleaning and drainage.

While the lands 52 and valleys 56 on the top surface 38 of each section 26,28 may be of any suitable configuration, in the exemplary device 20 as shown in FIGS. 2 and 8, the lands 52 each extend in a direction generally perpendicular to the pivot axis 30, with the resulting parallel-spaced lands 52 extending substantially across a longitudinal dimension of the section 26,28. These parallel-spaced, coplanar lands 52 provide a stable support surface upon which the next tier 24 of pallets rests (as illustrated in FIG. 1).

And, as seen in FIGS. 2 and 8, in order for the device 20 to assume a compact form when the first section 26 is folded or pivoted atop the second section 28, the top surface features (the lands 52 and the valleys 56) of the first section 26 are complementary to the surface features of the second section 28, and the pivot axis 30 of the device 20 lies between the first reference plane 54 defined by each section's lands 52 and a second reference plane 58 that intersects the lowermost portions of the valleys 56 defined on each section's top surface 38. In this manner, the lands 52 of the first section 26 oppose the valleys 56 of the second section 28 when the first section 26 is pivoted on top of the second section 28, resulting in the compact form illustrated in FIG. 9 that is well suited for stacked storage.

Most preferably, the first and second sections 26,28 have a substantially identical shape to facilitate manufacture of the device 20 using, for example, two identical, injection-molded plastic halves. Thus, to manufacture the exemplary device 20, a single mold is advantageously used to make each of the two sections 26,28, which are thereafter pivotally interconnected to each other along their respective first edges 36.

As best seen in FIGS. 3–5 and 7, while the invention contemplates any suitable hinge construction by which to pivotally interconnect the first 26 section with the second section 28, the hinge components of each section of the exemplary device 20 include pivot pins 32 that extend across a respective cut-out region 60 of the first edge 36, and projecting pin grips 34. The pin grip 34 preferably includes an opening 62 by which to removably-secure or "snap" the pin grip 34 about the pivot pin 32, thereby facilitating assembly of the device 20, for example, when the first section 26 is disposed roughly at a 90° angle with respect to the second section 28 (as illustrated in FIG. 2). It will be appreciated that the hinge components of each section 26,28 are intended to cooperate such that the first section 26 can be pivoted relative to the second section 28 between a first, "device-open" position, with the first section's bottom surface 42 nominally coplanar with that of the second section 28 (as illustrated in FIG. 1), and a second, "device-folded" position, with the first section's bottom surface 42 in a substantially parallel relation with the bottom surface 42 of the second section 28.

Figure 4:
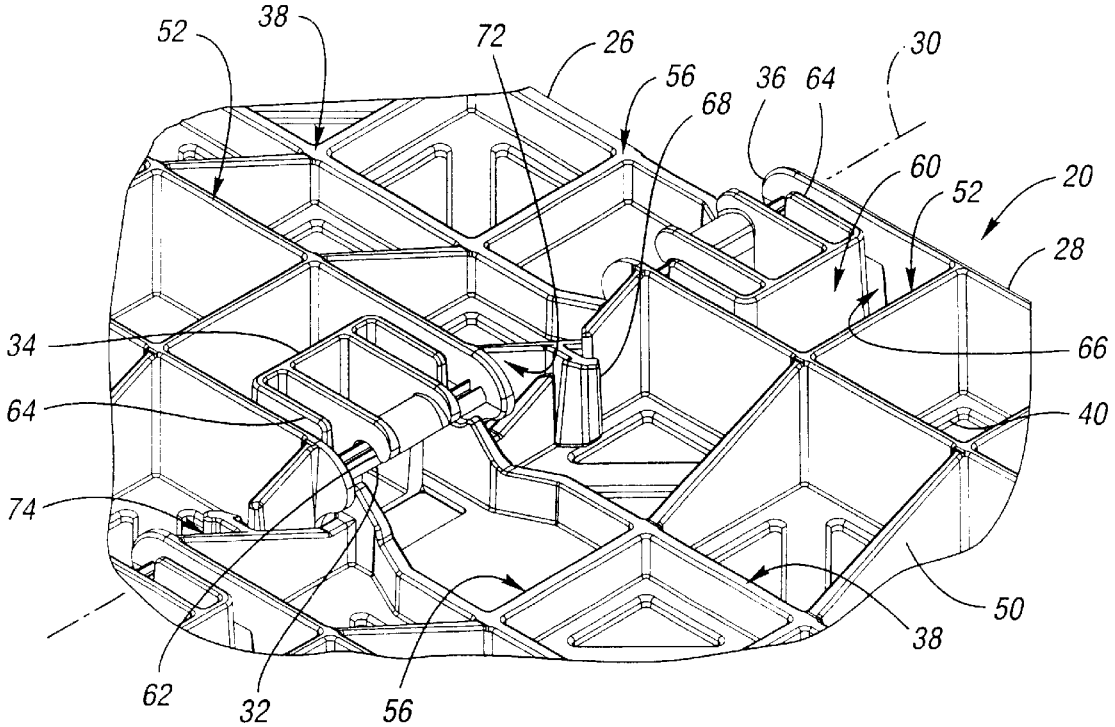
FIG. 4 is an enlarged view of the hinge shown in FIG. 3 once the device's two sections are fully opened to thereby place the bottom surfaces of the two sections into a substantially coplanar relationship.

In order to increase the rigidity of the device 20 when opened, for example, to facilitate automated movement of the device 20, each pin grip 34 of the exemplary device 20 includes a pair of oppositely- and laterally-extending fingers 64 that resiliently engage corresponding side surfaces 66 of the cut-out region 60. The hinged edge 36 of each section 26,28 also includes a plurality of tongues 68 and corresponding slots 70 that define a series of "snap-fitting" detents along the hinge of the device 20 that operate to lock the first section 26 relative to the second section 28 about the pivot axis 30 when the bottom surface 42 of the first section 26 is substantially coplanar with the bottom surface 42 of the second section 28. As seen in FIG. 4, the device 20 further includes cooperating edge features 72,74 that abuttingly engage as the bottom surface 42 of the first section 26 is urged into a substantially coplanar relationship with the bottom surface 42 of the second section 28, thereby further serving to maintain the coplanarity of the sections 26,28 of the opened device 20.

Figure 5:
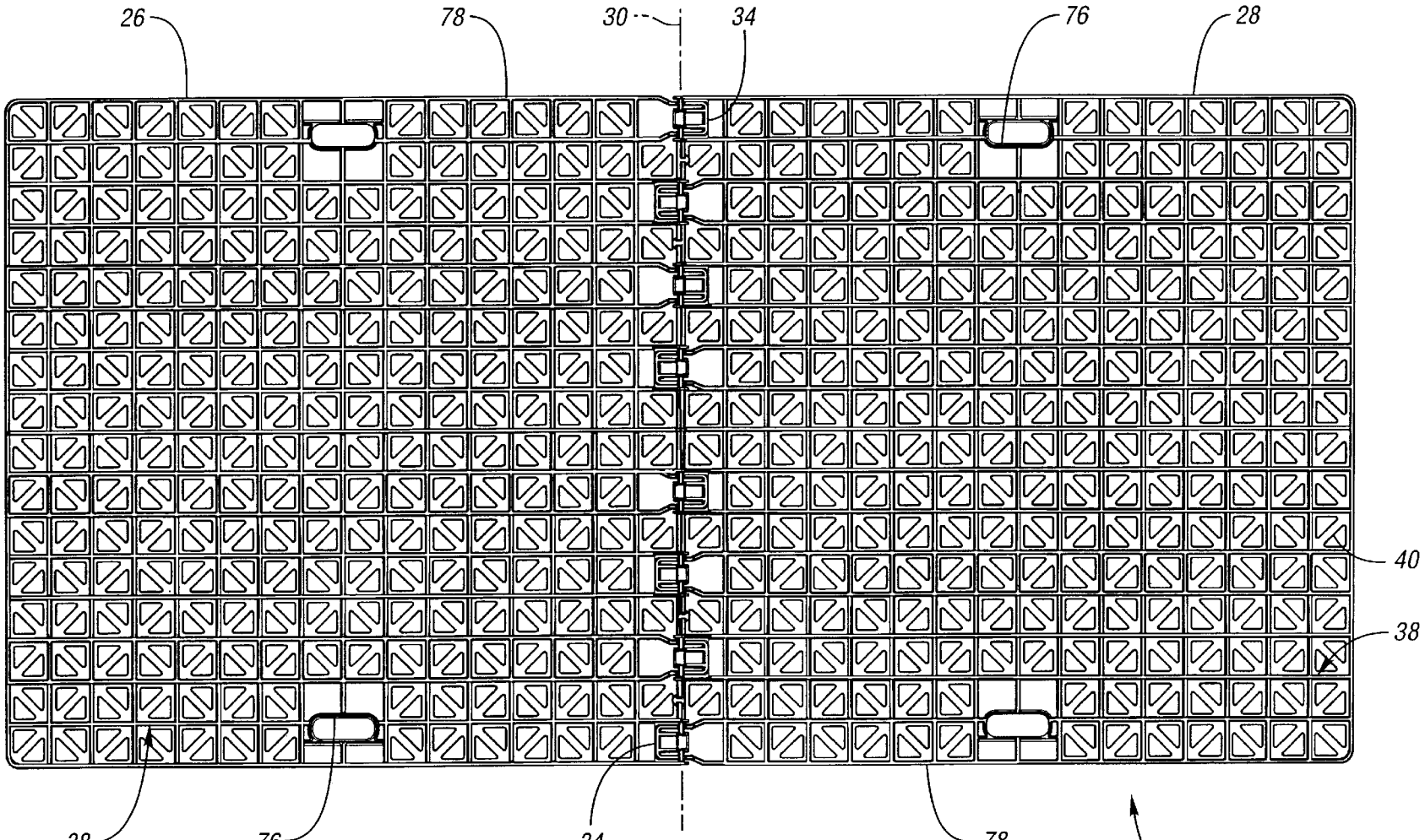
FIG. 5 is a top plan view of the device when the device is fully opened.

As best seen in FIGS. 5 and 7, the grid structure 34 of each section 26,28 of the device 20 further serves to define a pair of integral handles 76, whereby the opened device 20 is provided with handles 76 on each of its lateral edges 78 to facilitate handling of the device 20, including its placement atop a given tier 22,24 of adjacent pallets 14. The handles 76 are preferably defined in each section 26,28 such that, upon the folding of the device 20 for storage, the handles 76 of the first section 26 are generally aligned with the handles 76 of the second section 28, thereby further facilitating handling of the folded (closed) device 20.

While one embodiment of the invention has been illustrated and described, it is not intended that this embodiment illustrate and describe all possible forms of the invention. Rather, the words used in the specification are words of description rather than limitation, and various changes may be made within the scope of the appended claims. For example, while the pallet-stacking device is illustrated in FIG. 1 as separating each layer of loaded pallets, it will be appreciated that the device can conveniently be used to separate vertical pairs of loaded pallets to thereby facilitate use of a twin forklift that is capable of simultaneously lifting and transporting two vertically-stacked pallets, whereby the pallets are moved more quickly and efficiently about the warehouse.

What is claimed is:

1. An article for use in stacking adjacent pairs of loaded pallets comprising:

a pair of interconnected sections, each section having a generally flat bottom surface adapted to rest on top of a loaded pallet, a top surface including a plurality of raised surface features, and a first edge including a plurality of hinge components from the group consisting of a pivot pin and a pin grip, wherein an uppermost portion of each raised surface feature lies within a first reference plane, the first reference plane being in substantial parallel-spaced relation to the bottom surface, and wherein the hinge components of the sections cooperate to interconnect the sections for relative pivoting movement about a hinge line that lies beneath the respective first reference plane of each section, wherein the surface features include a plurality of raised portions separated by a plurality of lowered portions, and further wherein the surface features of a first one of the sections are complementary to the surface features of a second one of the sections when the first one is pivoted about the pivot axis on top of the second one, whereby the raised portions of the first one oppose the lowered portions of the second one when the first one is pivoted on top of the second one.

2. The article of claim 1, wherein the raised portions define generally parallel-spaced lands.

3. The article of claim 2, wherein the parallel-spaced lands extend in a direction generally perpendicular to the pivot axis.

4. The article of claim 3 wherein the parallel-spaced lands of a given section extend substantially across a dimension of the given section.

5. The article of claim 1, wherein the first one of the sections and the second one of the sections have a substantially identical shape.

6. The article of claim 1, wherein the pivot axis lies between the first reference plane of each section and a second reference plane intersecting the lowered portions of each section.

7. The article of claim 1, including a first edge feature on one section and a second edge feature on the other section, the first edge feature cooperating with the second edge feature to restrict relative pivoting movement of the sections about the pivot axis.

8. The article of claim 7, wherein the first edge feature engages the second edge feature as the bottom surface of the one section is urged into a substantially coplanar relationship with the bottom surface of the other section.

9. The article of claim 7, wherein the first edge feature and the second edge feature cooperate to define a detent for locking the one section relative to the other section about the pivot axis when the bottom surface of the one section is substantially coplanar with the bottom surface of the other section.

10. The article of claim 7, wherein one of the first edge feature and the second edge feature includes a tongue, and other of the first edge feature and the second edge feature includes a slot adapted to receive the tongue as the bottom surface of the one section is urged into a substantially coplanar relationship with the bottom surface of the other section.

11. The article of claim 7, wherein a first surface of the first edge feature on the one section abuttingly engages a first surface of the second edge feature to limit relative pivoting movement of the sections when the bottom surface of the one section is substantially coplanar with the bottom surface of the other section.

12. The article of claim 7, wherein the sections have a substantially identical shape.

13. The article of claim 1, wherein the first hinge component includes a pivot pin and the second hinge component includes a pin grip.

14. The article of claim 13, wherein a first pin grip on the first edge of a first one of the sections is removably secured about a first pivot pin on the first edge of a second one of the sections.

15. An article for use in stacking adjacent pairs of loaded pallets comprising:

a pair of interconnected sections, each section having a generally flat bottom surface adapted to rest on top of a loaded pallet, a top surface including a plurality of raised surface features, and a first edge including a plurality of hinge components from the group consisting of a pivot pin and a pin grip, wherein an uppermost portion of each raised surface feature lies within a first reference plane, the first reference plane being in substantial parallel-spaced relation to the bottom surface, and wherein the hinge components of the sections cooperate to interconnect the sections for relative pivoting movement about a hinge line that lies beneath the respective first reference plane of each section wherein each section includes a lip extending along a second edge and projecting downwardly beneath the bottom surface of the section.

16. An article for use in stacking adjacent pairs of loaded pallets comprising:

a pair of interconnected sections, each section having a generally flat bottom surface adapted to rest on top of a loaded pallet, a top surface including a plurality of raised surface features, and a first edge including a plurality of hinge components from the group consisting of a pivot pin and a pin grip, wherein an uppermost portion of each raised surface feature lies within a first reference plane, the first reference plane being in substantial parallel-spaced relation to the bottom surface, and wherein the hinge components of the sections cooperate to interconnect the sections for relative pivoting movement about a hinge line that lies beneath the respective first reference plane of each section wherein each section includes a handle defined in a peripheral portion, the handle of a first one of the sections being generally aligned with the handle of a second one of the sections when the first one is pivoted on top of the second one.

17. An article for use in stacking adjacent pairs of pallets loaded with container arrays having exposed container tops, the article including:

a pair of interconnected sections, each section having a generally flat bottom surface adapted to rest on the exposed container tops of a respective container array, a top surface including a plurality of raised surface features defining a plurality of parallel-spaced raised lands extending substantially across a dimension of the top surface and separated by a plurality of parallel-spaced valleys, and a first edge including a plurality of hinge components from the group consisting of a pivot pin and a pin grip, wherein an uppermost portion of each land lies within a first reference plane, and a lowermost portion of each valley lies within a second reference plane, the first and second reference planes being in a substantially parallel-spaced relation to the bottom surface, wherein the hinge components of the sections cooperate to interconnect the sections for relative pivoting movement about a pivot axis that is collinear with the respective pivot pins of the sections, the pivot axis lying between the first reference plane and the second reference plane of each section, and wherein the surface features of a first one of the sections are complementary to the surface features of a second one of the sections when the first one is pivoted about the pivot axis on top of the second one, whereby the raised lands of the first one oppose the valleys of the second one when the first one is pivoted on top of the second one.

18. The article of claim 17, including a first edge feature on the first edge of the first one of the sections and a second edge feature on the first edge of the second one of the sections, wherein the first edge feature engages the second edge feature as the bottom surface of the first one of the sections is urged into a substantially coplanar relationship with the bottom surface of the second one of the sections.

19. The article of claim 18, wherein the first edge feature and the second edge feature cooperate to define a detent for locking the sections together when the bottom surface of the first section is substantially coplanar with the bottom surface of the second section.

20. The article of claim 19, wherein each section includes a lip extending along a second edge and projecting downwardly beneath the bottom surface of the section.

21. A molded article for use in stacking loaded pallets, the article including:

a generally flat bottom surface, a top surface including a plurality of raised surface features defining a plurality of parallel-spaced raised lands extending substantially across a dimension of the top surface and separated by a plurality of parallel-spaced valleys, wherein an uppermost portion of each land lies within a first reference plane, and a lowermost portion of each valley lies within a second reference plane, the first and second reference planes being in a substantially parallel-spaced relation to the bottom surface, and a first edge including a plurality of hinge components from the group consisting of a pivot pin and a pin grip, the hinge components cooperating to define a pivot axis that is collinear with each pivot pin, the pivot axis lying between the first reference plane and the second reference plane.

22. The article of claim 21, including at least one edge feature on the first edge adapted to cooperate with a complementary feature of another article to resist relative movement of the article about the pivot axis when the hinge components of the article engage the other article.

23. The article of claim 21, wherein each section includes a lip extending along a second edge and projecting downwardly beneath the bottom surface of the section.

24. A device for use in stacking adjacent loaded pallets, the device comprising:

a first section and second section connected to each other, each section having a generally planar bottom surface adapted to rest on top of a loaded pallet and a top surface having a plurality of raised portions, each raised portion extending longitudinally across a dimension of the top surface, each section further having a first edge including a plurality of hinge components from the group consisting of a pivot pin and a pin grip, wherein an uppermost portion of the plurality of raised portions sits within a first reference plane that is in a substantially parallel-spaced relation to the bottom surface, and wherein the hinge components of the sections cooperate to interconnect the sections for relative pivoting movement about a hinge line that lies beneath the respective first reference plane of each section.

25. The device of claim 24, wherein each of the plurality of raised portions is oriented substantially parallel to the others.

26. The device of claim 25, wherein an adjacent pair of raised portions are separated a longitudinally extending recessed portion oriented generally parallel to the raised portions.

* * * * *

UNITED STATES PATENT AND TRADEMARK OFFICE

CERTIFICATE OF CORRECTION

PATENT NO. : 6,659,019 B2
DATED : December 9, 2003
INVENTOR(S) : Robert V. Gruber et al.

It is certified that error appears in the above-identified patent and that said Letters Patent is hereby corrected as shown below:

Column 10,
Line 20, after "separated" insert the word -- by --.

Signed and Sealed this

Second Day of March, 2004

JON W. DUDAS
*Acting Director of the United States Patent and Trademark Office*